US010226093B1

(12) United States Patent
Groteke et al.

(10) Patent No.: US 10,226,093 B1
(45) Date of Patent: Mar. 12, 2019

(54) BUNKER STRAP AND METHOD OF USE

(71) Applicants: Mark Groteke, Cincinnati, OH (US); Ronald Brian Weisbrodt, Cincinnati, OH (US)

(72) Inventors: Mark Groteke, Cincinnati, OH (US); Ronald Brian Weisbrodt, Cincinnati, OH (US)

( * ) Notice: Subject to any disclaimer, the term of this patent is extended or adjusted under 35 U.S.C. 154(b) by 193 days.

(21) Appl. No.: 14/693,960

(22) Filed: Apr. 23, 2015

Related U.S. Application Data

(60) Provisional application No. 61/984,928, filed on Apr. 28, 2014.

(51) Int. Cl.

| | |
|---|---|
| ***A41F 19/00*** | (2006.01) |
| ***A41F 17/02*** | (2006.01) |
| ***A41F 17/04*** | (2006.01) |
| ***A62B 17/00*** | (2006.01) |

(52) U.S. Cl.
CPC ..... *A41F 17/04* (2013.01); *A62B 17/003* (2013.01)

(58) Field of Classification Search
CPC ..... A41F 17/04; A62B 17/003
USPC ..... 2/323; 24/72.1, 391, 394; 36/71
See application file for complete search history.

(56) References Cited

U.S. PATENT DOCUMENTS

| | | | | |
|---|---|---|---|---|
| 3,200,414 | A * | 8/1965 | Sternberg | A41F 17/04 2/232 |
| 4,115,906 | A * | 9/1978 | Lavine | A41F 17/04 2/233 |
| 5,129,105 | A * | 7/1992 | Kleinman | A41F 3/00 2/326 |
| 5,313,669 | A * | 5/1994 | Rasdell | A41F 17/00 2/107 |
| 5,542,156 | A * | 8/1996 | Oglesby | A41F 17/04 2/233 |
| 6,681,459 | B1 * | 1/2004 | Curet | A43C 9/06 24/300 |
| 7,103,944 | B2 * | 9/2006 | Johnson | A47J 36/06 220/315 |
| 7,401,386 | B2 * | 7/2008 | Cannon | A41B 13/10 24/298 |
| 2009/0031537 | A1 * | 2/2009 | Muscarella | A41F 17/04 24/72.1 |
| 2014/0283412 | A1 * | 9/2014 | Elder | A43B 13/127 36/102 |

* cited by examiner

*Primary Examiner* — Timothy K Trieu
(74) *Attorney, Agent, or Firm* — Mark F. Smith; Smith Brandenburg Ltd.

(57) ABSTRACT

The subject invention is a bunker strap for attaching to two sides of a lower opening of a bunker pant leg of bunker pants, the bunker strap comprising an elongated band having a first end with a fastener for attaching to the pant leg and a second end with a fastener for attaching to the pant leg; wherein the elongated band is of sufficient length to be routed from one side if the lower opening, around a sole of a firefighter boot, and upwardly towards the other side of the lower opening.

7 Claims, 8 Drawing Sheets

BUNKER STRAP AND METHOD OF USE

CROSS-REFERENCE TO RELATED APPLICATION

The present invention relates to U.S. Provisional Patent Application No. 61/984,928, filed Apr. 28, 2014, entitled: Bunker Strap and Methods Thereof, and is incorporated in its entirety herein by reference.

BACKGROUND OF THE INVENTION

Firefighters, because of the nature of their work, are required to use fire protective clothing. This clothing includes firefighting pants (sometimes referred to as "bunker pants") and firefighting boots. Due to the bulkiness and fire resistant properties of the bunker pants, the pant legs of the bunker pants are worn by the firefighters on the outside of the boots. However, when a firefighter is operating at a fire or other type of emergency scene, the lower portion of the bunker pant legs can be undesirably drawn up the firefighter's leg. In some cases, a pant leg can be drawn up the firefighter's leg such that some of the boot's uppers or even the firefighter's skin or other undergarments are exposed. This undesirable "ride-up" of the pant leg can occur in any number or situations. For example, when a firefighter is bending over or crawling along the ground, or otherwise performing various physical actions as may be required at an emergency scene, the pant leg can be inadvertently drawn up the leg.

Accordingly, it is desirable to have a device and a method for use by firefighters that operates to prevent the pants legs from ridding-up a firefighter's legs. It is also desirable that such a device is easy to attach to the firefighter's pants, is comfortable to wear, is relatively easy to place into position to operate and to remove; has good flame and heat resistance, and is relatively inexpensive to manufacture.

SUMMARY OF THE INVENTION

The subject invention is a bunker strap for attaching to two sides of a lower opening of a bunker pant leg of bunker pants, the bunker strap comprising an elongated band having a first end with a fastener for attaching to the pant leg and a second end with a fastener for attaching to the pant leg; wherein the elongated band is of sufficient length to be routed from one side if the lower opening, around a sole of a firefighter boot, and upwardly towards the other side of the lower opening.

In a preferred embodiment of the invention the elongated band is formed from an elastic material.

In another preferred embodiment of the invention the elongated band is formed from a fire and heat resistant flexible material.

In another preferred embodiment of the invention the elongated band is formed from a coated nylon or aramid fibers or strands.

In another preferred embodiment of the invention the bunker strap further comprises a reflective material on the elongated band.

In a preferred embodiment of the invention the reflective material is metallized polyester strands or fibers, or aluminum strands or fibers, or fluorescent strands or fibers.

In another preferred embodiment of the invention the bunker strap further comprises a protective sheath over the elongated band.

In a preferred embodiment of the invention the protective sheath is formed from a fire and heat resistant flexible material.

In preferred embodiment of the invention the protective sheath is formed from a coated nylon or aramid fibers or strands.

In a preferred embodiment of the invention the bunker strap further comprises a reflective material on the protective sheath.

In a preferred embodiment of the invention the reflective material is metallized polyester strands or fibers, or aluminum strands or fibers, or fluorescent strands or fibers.

Various other objects, advantages, and embodiments of the invention will be apparent from the following description, the accompanying drawings, and the appended claims.

BRIEF DESCRIPTION OF THE DRAWINGS

To provide a more complete understanding of the present invention and further features and advantages thereof, reference is now made to the following description taken in conjunction with the accompanying drawings, in which.

DETAILED DESCRIPTION OF THE INVENTION

The subject invention is directed to a bunker strap and a method of use that operates to keep a pant leg from ridding up a firefighter's leg. In describing the invention various non-limiting embodiments of the present invention will be described to provide an overall understanding of the principles of the device including its structure and function and methods of use. One or more examples of these non-limiting embodiments are illustrated and are disclosed in detail with reference to the accompanying Drawings. It should be understood that the features illustrated or described in connection with one or more non-limiting embodiments may be combined with the features of the other non-limiting embodiments. Such modifications and variations are intended to be included within the scope of the present disclosure.

As used herein the terms "downward" or "downwardly" refer to the direction generally away from the firefighter's head and towards the bottom (sole) of the firefighter's boot. The terms "upward" or "upwardly" refers to the direction away from the bottom (sole) of the firefighter's boot and towards the firefighter's head.

Typically, bunker pants when worn are held up with suspenders. The suspenders operate to exert an upward force on the pants to cause the pant legs to pull away from the ground and the boot. The present invention is directed to bunker straps which generally maintain their proper orientation at the lower portion of bunker pants to prohibit, or limit, the lower portion of each pant leg from riding upward and over the upper portion of the boot. In use, the bunker strap of the subject invention operates to pull against the force of the suspenders thereby keeping the bunker pants taut and drawn downwardly to cover the top portion of the boot, thus, adding protection and comfort to the firefighter.

Figure 1:
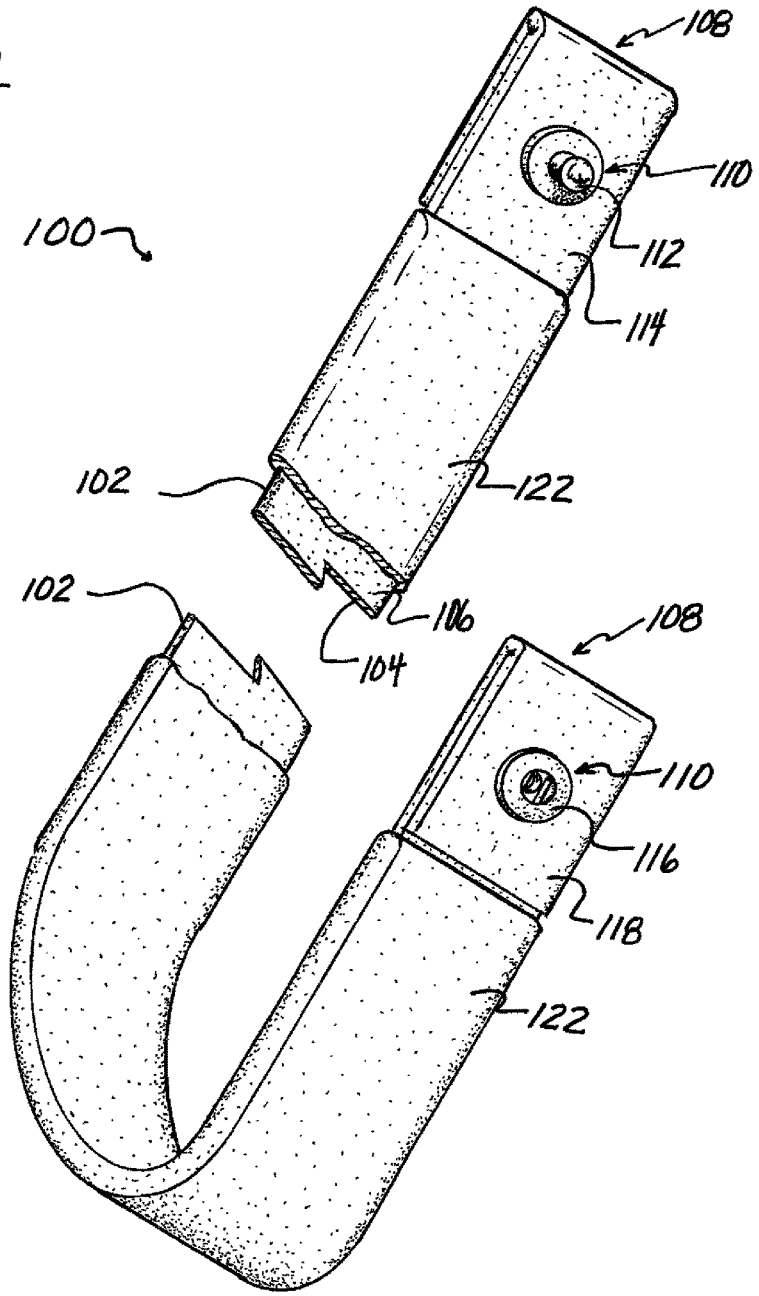
FIG. 1 is a perspective view of a preferred embodiment of the bunker strap of the subject invention showing an elongated band and fasteners for attaching to the lower lag of a firefighter's pant leg.

Referring to FIG. 1, a preferred embodiment of the bunker strap 100 of the subject invention is shown in its unattached state. As shown, the bunker strap comprises an elongated band 102 having an outer side 104 and an inner side 106 and first and second end portions 108 each having a fastener 110. In one embodiment, the elongated band 102 is formed from an elastic material such that it can expand and contract longitudinally. In other embodiments, the elongated band 102 is formed from a material that is not stretchable.

In a preferred embodiment, as shown in FIG. 1, the fasteners 110 are snap fasteners having a male component 112 attached to the inner side 114 of the end portions 108 of the bunker strap 100 and female components 116 attached to the outer side 118 of the end portions 108 of the bunker strap 100. It should be understood that the type of fastener and the particular arrangement of the fasteners 110 can be configured to correspond with the particular connectors used for the lower openings 12 of the bunker pant legs 14 for the particular bunker pants 10. Thus, while fastener 110 is a snap fastener as illustrated in FIG. 1, it is to be appreciated that the fasteners are any suitable type of fastener or combination of devices, such as buttons, button-holes, zippers, ties, latches, hook-and-loop fasteners, buckles, clamp type, and other similar type of fasteners that are effective for attaching the end portions 108 of the bunker strap 100 to the pant legs 14.

The bunker strap 100, or components thereof, is manufactured from a number of suitable materials, such as high performance fire and heat resistant flexible fiber or strands having elastic characteristics and sufficient tensile strength to resist failure and wear. Such materials include, but not limited to, coated nylon, aramid fibers (such as, but not limited to NOMEX® and KEVLAR® provided by E.I. du Pont de Nemours and Company of Wilmington, Del.), synthetic polyamides or a combination thereof and can be in the form of fiber or strands that are woven, braided, or knitted, for example.

Figure 2:
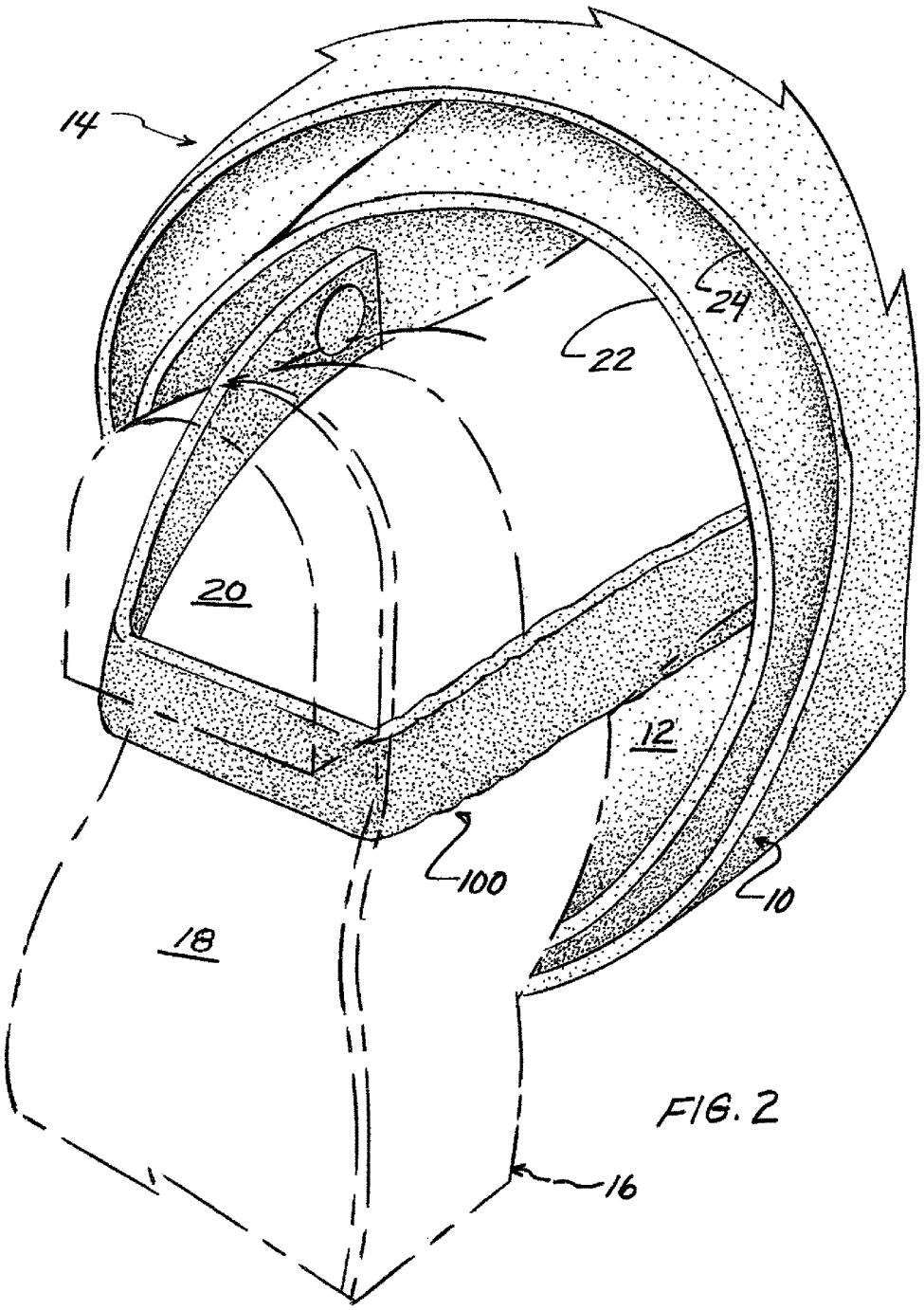
FIG. 2 is a perspective view showing the bunker strap of the subject invention attached to a pant leg of a firefighter and positioned such that it is spanning the sole of the firefighter's boot.

The bunker strap 100 of the subject invention is sized for example based on the style and size of the firefighting boot, the size of the bunker pants, and so forth as would be known to one skilled in the art such that the bunker strap can attach to one side of the pant leg opening and extend under the boot and attach to the opposing side of the pant leg opening, such as shown in FIG. 2. In a preferred embodiment, the bunker strap 100 has a width in the range of about 1.27 cm-1.91 cm (0.5-0.75 inches) and has a length in the range of about 21.59 cm-22.86 cm (8.5-9 inches).

Figure 3:
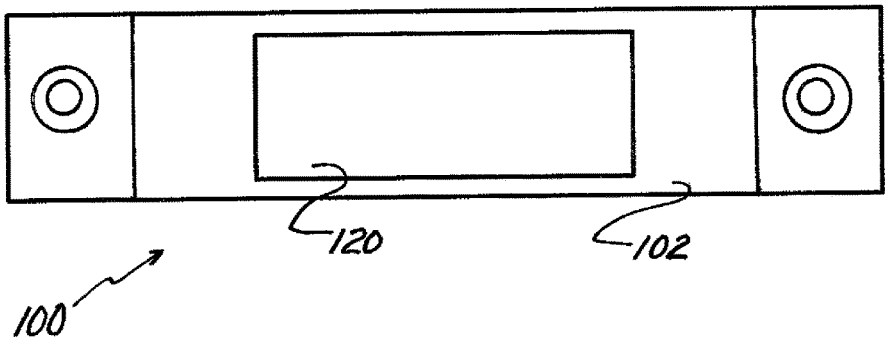
FIG. 3 is a schematic plan view of another embodiment of the bunker strap of the subject invention showing a reflective portion positioned along the elongated band.

In another preferred embodiment of the invention, as illustrated in FIG. 3, the bunker strap 100 further comprises a reflective material 120 woven within or placed along the surface (as shown) of the the elongated band 102. Such reflective material 120 can be in the form of metallized polyester strands, aluminum strands, and other such fibrous or strand material having reflective properties or other highly visible material, such as a fluorescent material fibers or strands.

Figure 5:
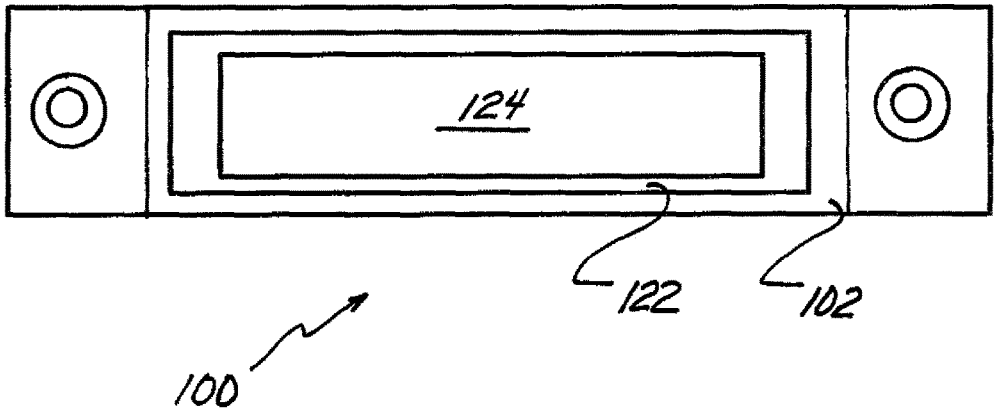
FIG. 5 is a plan view of a preferred embodiment of the bunker strap of the subject invention showing the elongated band and a protective sheath having a reflective portion thereon.

In another preferred embodiment, as illustrated in FIG. 1, the bunker strap 100 further comprises a protective sheath 122 positioned over the elongated band 102. Preferably, the protective sheath 122 is formed of a durable and fire resistant material and, in one embodiment, includes a reflective portion 124 (FIG. 5). Once positioned on the bunker strap 100, the protective sheath 122 operates to protect the bunker strap 100 in operational conditions and generally limit wear and tear on the other components of the bunker strap. Such materials include, but not limited to, coated nylon, aramid fibers (such as, but not limited to NOMEX® and KEVLAR® provided by E.I. du Pont de Nemours and Company of Wilmington, Del.), synthetic polyamides or a combination thereof. The fiber or strands can be woven, braided, or knitted, for example. In another preferred embodiment of the invention, the protective sheath 122 is removable, such that it can slide along the elongated band 102 and removed. Accordingly, when the protective sheath 122 becomes worn, it can be easily replaced with a new protective sheath.

As stated, in another embodiment of the invention, as illustrated in FIG. 5, the protective sheath 122 includes a reflective portion 124. Preferably, the reflective portion 124 is formed from a reflective material such as a polyester material having a sliver film, a metallized polyester film having a protective lacquer film, a polyester film metallized with an aluminum deposit with a clear colorless lacquer deposited thereon, of other such material. In another preferred embodiment, the reflective portion 124 is formed from an outer reflective coating formed from or with a reflective material such as glass beads embedded into an adhesive layer deposited along the protective sheath 122 that operates to improve the wear resistance and visibility of the bunker strap 100.

Figure 4:
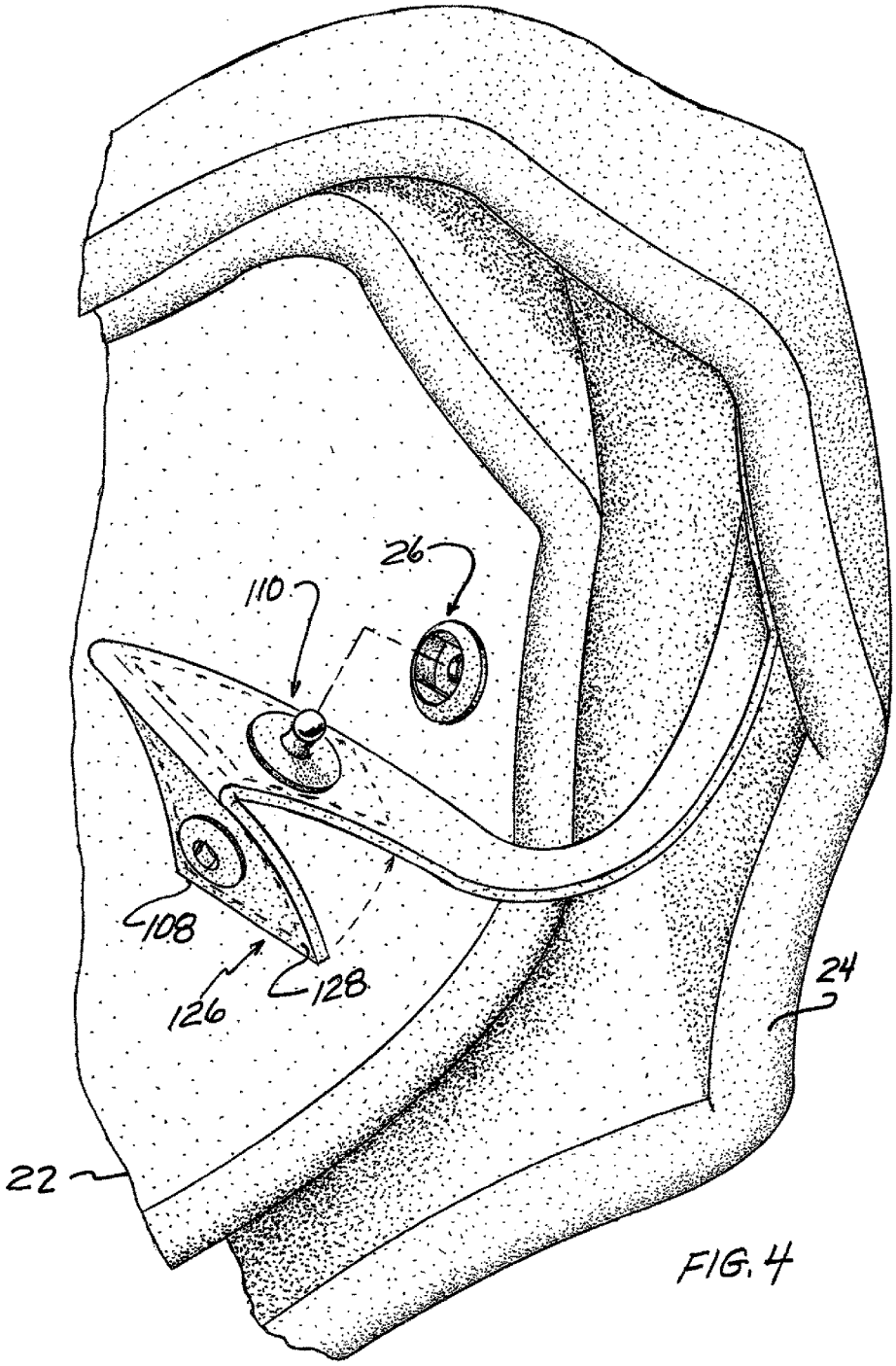
FIG. 4 is a perspective view showing a portion of the lower portion of a pant leg having an inner liner layer and an outer shell layer that attach together by connectors and the bunker strap having a fasteners for attaching to the connectors of the inner liner layer and the outer shell layer.

In another preferred embodiment, as shown in FIGS. 1 and 4, the end portions 108 each end of the elongated band 102 comprise a fold-over 126. The fold-over 126 is secured by sewing the folded portion 128 with a fire resistant thread, or using any other connection technique, such as a rivet, for example. The fold-over 126 operates to add additional strength at the end portions 108 and reduces the likelihood of the bunker strap 100 fraying or breaking during use.

In use, as illustrated in FIG. 2, a firefighter wearing bunker pants 10 and firefighting boots 16 has the bunker strap 100 of the subject invention attached to the bunker pants leg 14. The pants leg 14 has a lower pant leg opening 12 is shown such that the bunker strap 100 coupled to both sides of the lower pant leg' lower opening 12 of the bunker pant leg 10 such that the bunker strap 100 generally spans the lower opening 12. The elongated band 102 of the bunker strap 100 is of sufficient length such that is capable of being routed downwardly from one side of the lower pant leg opening 12, around the sole 18 of the firefighting boots 16, and upwardly towards the other side of the pant leg lower opening 12. In a preferred embodiment, the bunker strap 100 is positioned such that it spans the sole 18 of the firefighting boot 16 at a position that is immediately forward of the heel 20 and proximate an arch of the sole 18. Once coupled to the bunker pants 10, the bunker strap 100 can generally keep the bunker pant leg 14 of the bunker pants 10 drawn toward the sole 18, even when forces are acting to draw the bunker pant legs 14 upward and away from the sole 18.

As stated and illustrated in FIG. 4, the bunker pants 10 typically have an inner liner 22 and an outer layer 24. These two layers can be selectively joined by a pair of connectors 26, such as snap connectors as is known in the art, positioned on opposite sides of the pants leg lower opening and each connector 26 having a male portion and a female portion that mate to attach the inner liner 22 to the outer layer 24. In the illustrated embodiment, the bunker strap 100 of the subject application operates such that fastener 110 of the first end portion 108 mates with the snap connector 26 on the inner liner 22 and the outer layer 24 of one side of the pant leg lower opening 12 and the fastener 110 of the second end portion 108 mates with the snap connector 26 on the inner liner 22 and the outer layer 24 of the opposite side of the pant leg lower opening 12. In this way the inner liner 22 is coupled to the outer layer 24 by use of the bunker strap fastener 110. Thus, the snap connections 26 also serve as anchor points for the bunker straps 100.

Figure 6:
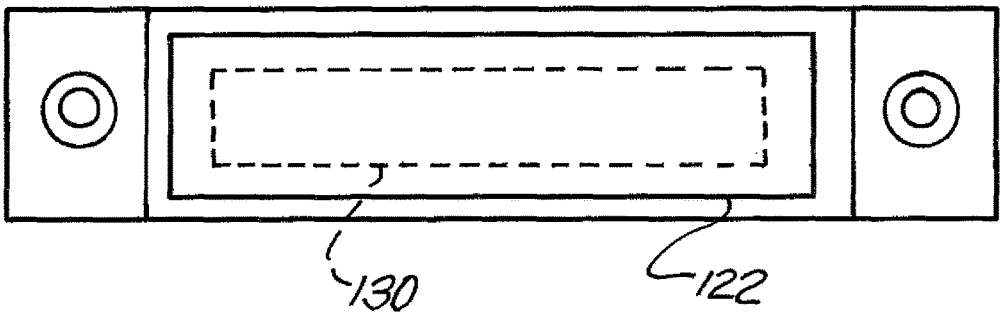
FIG. 6 is a schematic plan view of another embodiment of the bunker strap of the subject invention showing an elastic portion positioned within the protective sheath.
Figure 7:
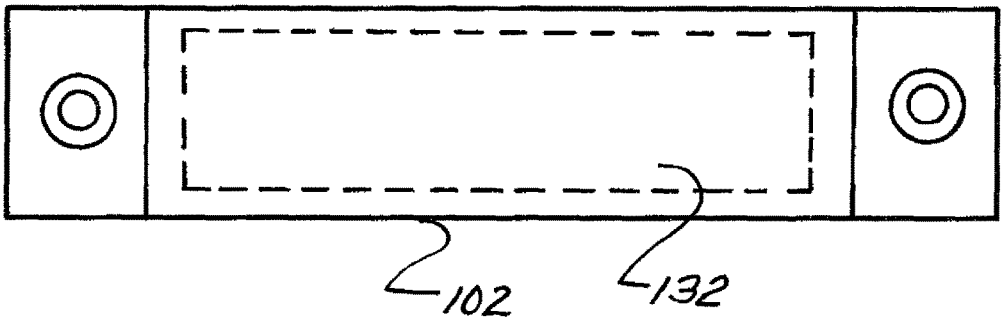
FIG. 7 is a schematic plan view of another embodiment of the bunker strap of the subject invention showing an elastic portion positioned within the elongated band.

In another preferred embodiment, as illustrated in FIG. 6, the bunker strap 100 of the subject invention, the protective sheath 122 includes an elastic member 130. The elastic member 130 is positioned within the protective sheath 122 and extends from either longitudinal end of the protective sheath 122. It should be understood that some embodiments of the bunker strap 100, however, do not utilize a protective sheath 122. As shown in FIG. 7, in another preferred embodiment of the invention the elongated band 102 includes an elastic member 132 positioned within the elongated band 102 and extends longitudinally from either end of the elongated band 102. It should be understood that the elastic members 130 and 132 can be configured to stretch and expand to accommodate some limited movement of the pant leg 14 relative to the firefighting boot 16, while the position of the protective sheath 122 and/or elongated band 102 relative to the firefighting boot 16 are generally maintained. It should also be understood that the elastic members 130 and 132 can be incorporated within the protective sheath 120 and the elongated band 102, respectively, such as separate sections of the protective sheath or elongated band or can be separate sections of the protective sheath 120 and/or elongated band 102.

Figure 8:
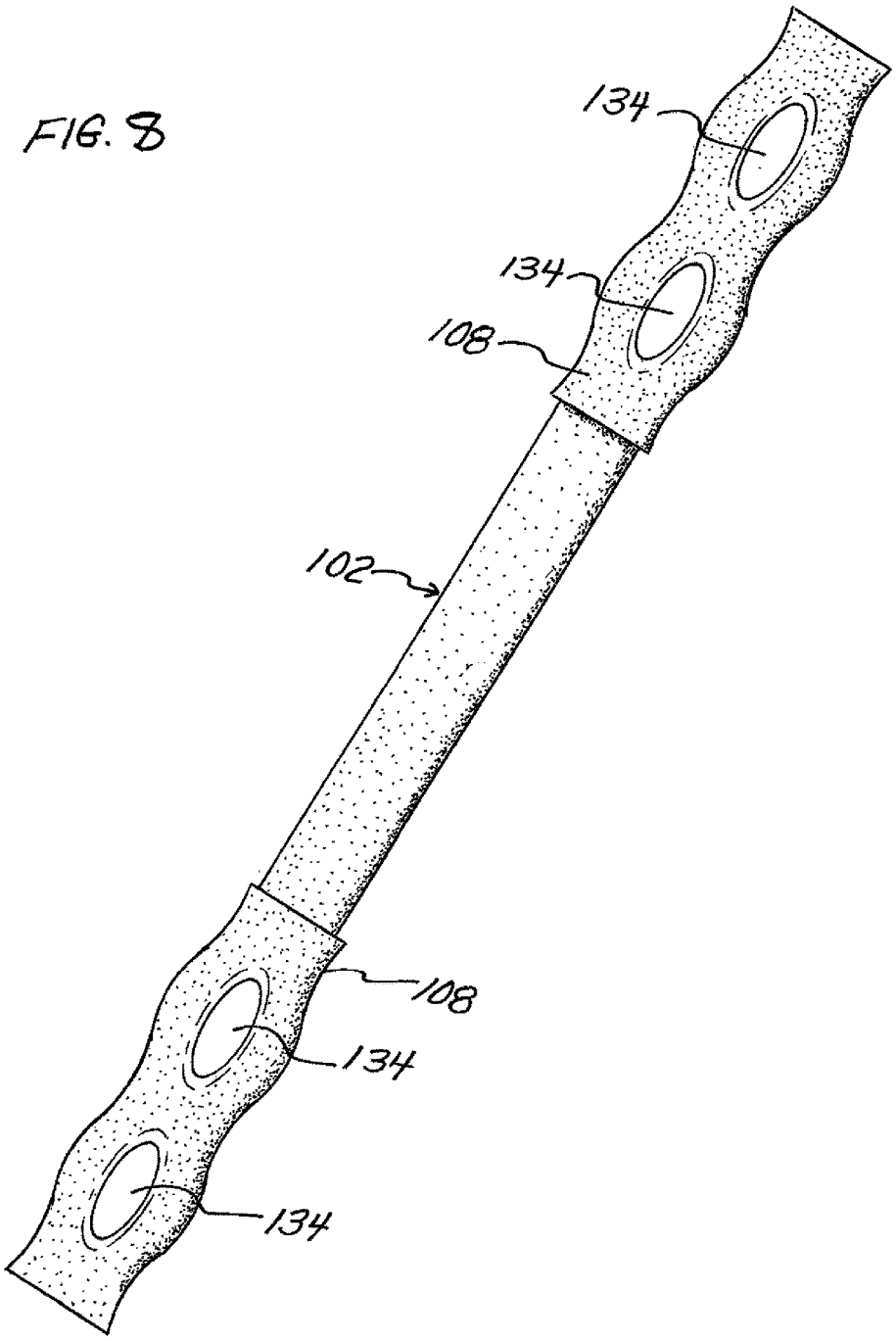
FIG. 8 is a plan view of another preferred embodiment of the bunker strap of the subject invention wherein the fasteners are in the form of button-type holes for receiving a button-type connectors.

While FIGS. 1-6 illustrate the coupling of the bunker strap 100 to bunker pants 10 through direct attachment to the connections 26, this disclosure is not so limited. Bunker strap 100 shown in FIG. 8, for example, defines button-type holes 134 that are positioned at opposing end portions 108 of the elongated band 102. While the bunker strap 100 of FIG. 8 defines four button-holes, it is to be appreciated that any suitable number of button-holes can be used, such as two, six, eight, and so forth. The button-holes 134 can be configured to receive buttons, toggles, or other connectors 26 that are used to connect the inner liner 22 and the outer layer 24 of the bunker pants 10. In some embodiments, the connectors 26 (FIGS. 1-6), such as in the form of snap connectors, can be unsnapped and then re-snapped through the appropriate button-type hole 134 in order to couple the bunker strap 100 to the bunker pants 10. When multiple button-type holes are provided, in order to provide size adjustability, the firefighter can select any of the desired button-type holes to receive the connector 26 in order to achieve the desired fit. In some cases, the connector, such as the snap tab of a snap type connector, can be fed through the button-type hole 134 when the bunker strap 100 is coupled to the bunker pants 10. In addition to button-type holes, a wide variety of other attachment connectors can be used. In some embodiments, for example, hook and pile connectors can be utilized at each end of the bunker strap.

In use, the connectors, such as snap connectors, can be unsnapped prior to the installation of the bunker strap. Once the connector, such as a snap connector, is in an un-snapped state, the male component of the fastener of the bunker strap is coupled to the female component of the snap connector of the bunker pant leg and the female component of the fastener of the bunker strap (which is positioned on the opposing side of the bunker strap) is coupled to the male component of the snap connector of the bunker pant leg. Therefore, once the bunker strap is fully attached, the female component of the snap connector is indirectly coupled to the male component of the snap connector by way of the fastener on the end portion of the bunker strap.

It is to be understood that the figures and descriptions of the present disclosure have been simplified to illustrate elements that are relevant for a clear understanding of the present disclosure, while eliminating, for purposes of clarity, other elements. Those of ordinary skill in the art recognize, however, that these sorts of focused discussions would not facilitate a better understanding of the present disclosure, and therefore, a more detailed description of such elements is not provided herein.

It should now be understood to one skilled in the art that the bunker strap of the subject invention can be used by firefighters and operates to prevent the pants legs of the firefighter's bunker pants from ridding-up a firefighter's legs. It should also now be understood that the bunker strap of the subject invention is easy to attach to the firefighter's bunker pants, is comfortable to wear, is relatively easy to place into position to operate and to remove; has good flame and heat resistance, and is relatively inexpensive to manufacture.

We claim:

1. A bunker strap for attaching to two sides of a lower opening of a bunker pant leg of bunker pants, the bunker strap comprising:

an elongated band formed from an elastic material and having a first end and a second end;

a first fastener attached to said first end for attaching to the pant leg and a second fastener attached to said second end for attaching to the pant leg;

wherein said first and second fasteners formed from snap fasteners; a protective sheath wraps around said elongated band and having a first reflective material attaches to said protective sheath;

wherein said protective sheath configure to slide along said elongated band and for removing said protective sheath from said elongate band;

wherein said elongated band is of a length such that the elongated band configure to route from one side of the lower opening, around a sole of a firefighter boot, and upwardly towards the other side of the lower opening; and wherein said protective sheath is formed from a fire resistant material comprising a coated nylon strands or aramid fibers.

2. The bunker strap of claim 1 wherein said elongated band is formed from a fire and heat resistant flexible material.

3. The bunker strap of claim 1, wherein said first reflective material is formed from of metallized polyester strands, aluminum strands, fluorescent strands or fibers.

4. The bunker strap of claim 1 wherein said elongated band is formed from aramid fibers or strands.

5. The bunker strap of claim 1 further comprising a second reflective material on said elastic band.

6. The bunker strap of claim 5 wherein said second reflective material is metallized polyester strands, aluminum strands, fluorescent strands or fibers.

7. A bunker strap for attaching to two sides of a lower opening of a bunker pant leg of bunker pants, the bunker strap comprising:

an elongated band formed from an elastic material and having a first end and a second end;

a first fastener attached to said first end for attaching to the pant leg and a second fastener attached to said second end for attaching to the pant leg;

wherein each of said first and second fasteners including at least a hole to couple the bunker strap to the bunker pants;

a protective sheath wraps around said elongated band;

wherein said protective sheath configure such that said elongated band to slide with respect to said protective sheath;

wherein said elongated band is of a length such that the elongated band configured to route from one side of the lower opening, around a sole of a firefighter boot, and upwardly towards the other side of the lower opening; and wherein said protective sheath is formed from a fire resistant material.

* * * * *